United States Patent [19]

Olsson

[11] Patent Number: 4,662,698

[45] Date of Patent: May 5, 1987

[54] ELECTRICAL TERMINAL HAVING WIRE-RECEIVING SLOT FORMED FROM TWO PLATE-LIKE MEMBERS

[75] Inventor: Billy E. Olsson, New Cumberland, Pa.

[73] Assignee: AMP Incorporated, Harrisburg, Pa.

[21] Appl. No.: 773,494

[22] Filed: Sep. 9, 1985

Related U.S. Application Data

[63] Continuation-in-part of Ser. No. 704,458, Feb. 22, 1985, Pat. No. 4,600,259.

[51] Int. Cl.[4] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,958,853 | 5/1976 | Wilson | 339/99 R |
| 4,060,302 | 11/1977 | Saligny | 339/97 R |
| 4,153,324 | 5/1979 | Kukla | 339/97 R |
| 4,262,984 | 4/1981 | Takahashi | 339/97 R |
| 4,466,681 | 8/1984 | Meindl | 339/97 R |

*Primary Examiner*—Joseph H. McGlynn

*Attorney, Agent, or Firm*—Frederick W. Raring; Bruce J. Wolstoncroft

[57] ABSTRACT

Electrical terminal having wire-receiving slot comprises two plate-like members in parallel aligned relationship. The plate-like members have opposed internal surfaces which are spaced apart in a wire-receiving and contact section so that the slot is the gap between the two surfaces. The plate-like members are secured to each other, preferably by welding.

9 Claims, 6 Drawing Figures

ELECTRICAL TERMINAL HAVING WIRE-RECEIVING SLOT FORMED FROM TWO PLATE-LIKE MEMBERS

RELATIONSHIP TO PENDING U.S. APPLICATIONS

This application is a continuation-in-part of Application Ser. No. 704,458 filed Feb. 22, 1985 now U.S. Pat. No. 4,600,259 which is hereby incorporated by reference in its entirety.

FIELD OF THE INVENTION

This invention relates to electrical terminals having a wire-receiving slot for establishing contact with a wire inserted into the slot. The invention is particularly concerned with terminals composed of two plate-like members in parallel aligned relationship.

BACKGROUND OF THE INVENTION

A widely used method of connecting a wire to a terminal is to form a wire-receiving slot in the terminal by punching the slot with a punch and die. The slot must, of course, be more narrow than the diameter of the wire to which the connection is made and a serious limitation on this type of wire connection is that it is impractical to form slots in terminals by punching which are significantly less than the thickness of the material or sheet metal from which the terminal is produced. This limitation has, in the past, precluded the use of wire-in-slot connections for wires having a diameter of less than about 0.33 mm. The stock metal from which the terminal is produced must be of some minimum thickness, as a practical matter, in order that it will be sufficiently rigid and sturdy to withstand its normal service and it is not practical to use metal stock having a thickness of much less than 0.33 mm in the manufacture of terminals. This means that the slots cannot have a width of much less than 0.33 mm. As a practical matter therefore, wire-in-slot type electrical connections are not used for AWG 32 wires and wires finer than AWG 32. An AWG 32 wire has a diameter of about 0.20 mm and the slot required for a wire having this diameter would need to be about 0.1 mm. As a practical matter, it is impossible to punch a slot having a width of about 0.1 mm in sheet metal having a thickness which is sufficient to be used in the manufacture of terminals.

The above-identified U.S. Application Ser. No. 704,458 describes in detail a terminal having a wire-receiving slot which does not require the punching operation as described above. The terminal comprises two plate-like members in parallel aligned relationship. The plate-like members have opposed internal surfaces and these internal surfaces are spaced apart in a wire-receiving portion of the terminal so the slot is in effect the gap or space between the opposed internal surfaces. The preferred method of manufacturing terminals of this type as described in Application Ser. No. 704,458 is to form a flat blank and then fold the blank to provide the two plate-like members in parallel aligned relationship.

The present invention is directed to the achievement of a terminal device as broadly described in Application Ser. No. 704,458 and the invention is particularly directed to the achievement of a terminal which can be manufactured by an alternative manufacturing method and which has certain advantages under some circumstances.

THE INVENTION

The invention comprises a sheet metal electrical terminal of the type comprising a shank portion having first and second plate-like members in side-by-side aligned relationship. The plate-like members have opposed first and second major internal surfaces and the shank portion has a free end, an inner end, and first and second side edges which extend from the free end to the inner end. The shank portion has a wire-receiving and contacting section which extends from the free end to an intermediate location which is between the free end and the inner end. The opposed first and second internal surfaces are spaced apart in the wire-receiving and contacting section whereby a wire-receiving slot is provided between the first and second opposed internal surfaces. The slot extends from the free end towards the intermediate location. The terminal of the present invention is characterized in that the terminal comprises first and second substantially similar flat sheet metal parts, the first and second sheet metal parts being the first and second plate-like members, respectively. The opposed first and second major internal surfaces are substantially against each other in a connecting zone, the connecting zone being between the intermediate location and the inner end of the shank portion. The first and second sheet metal parts are secured to each other in the connecting zone so that the terminal is in effect, a bipartite device, the two parts being secured to each other.

In accordance with a preferred embodiment, the two parts are welded to each other in the connecting zone and the plate-like members are coined to reduce thicknesses in the wire-receiving and contact sections of the terminal.

In accordance with the method aspect of the present invention, terminals as described above are produced by stamping out from flat sheet metal stock first and second flat blanks for the first and second plate-like members. The blanks are positioned against each other in parallel aligned relationship and are secured to each other in the connecting zone which is between the intermediate location and the inner end of the shank portion.

THE DRAWING FIGURES

THE DISCLOSED EMBODIMENT

Figure 1:
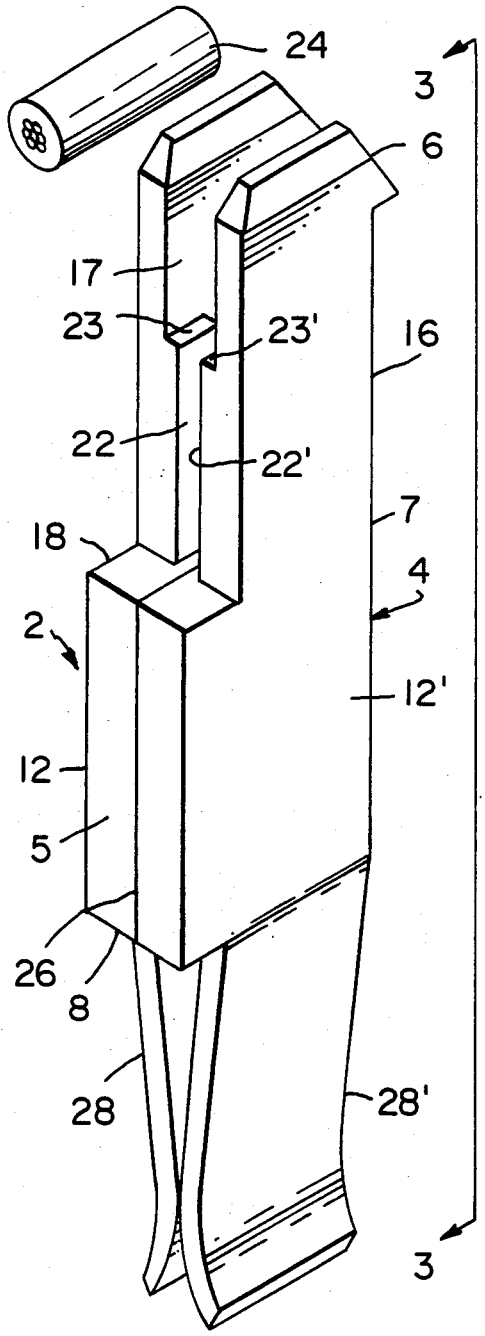
FIG. 1 is a prospective view of a terminal in accordance with the invention.

One form of terminal in accordance with the invention 2, FIG. 1, has a shank portion 4 which has an upper or free end 6 and an inner end 8. Side edges 5, 7 extend from the free end to the inner end 8 of the shank portion and a pair of spring arms 28, 28' extend from the inner end. Other contact devices might be used in place of the spring arms, for example, a solder post or the like.

Figure 2:
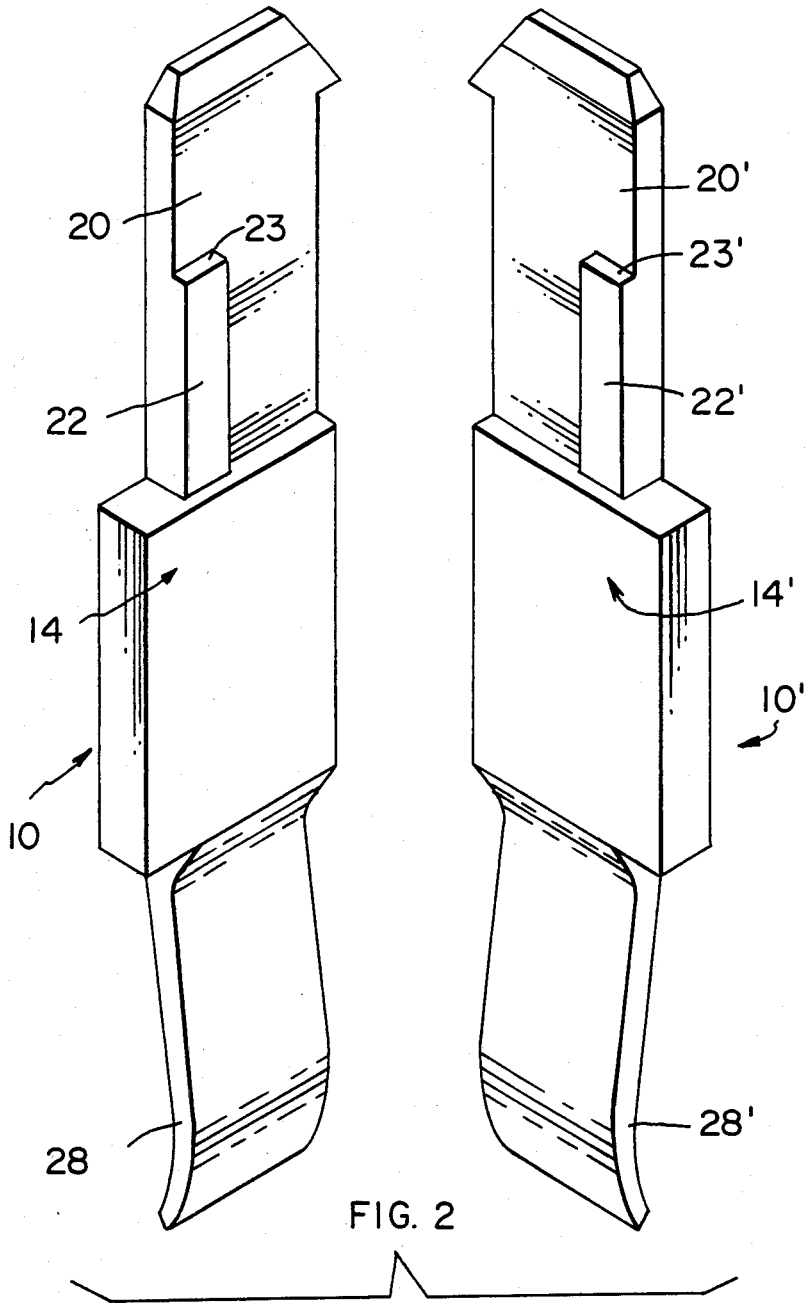
FIG. 2 is a view similar to FIG. 1 but showing the two parts of the terminal exploded from each other.

The terminal 2 is a bipartite device composed of first and second plate-like members 10, 10', FIG. 2, which are mirror images of each other. Accordingly, the same reference numerals, differentiated by prime marks, are used for corresponding structural features of the two members 10, 10'.

When the two members are assembled to each other as will be described below, the finished terminal of FIG. 1 has oppositely facing major external surfaces 12, 12' and they have opposed internal major internal surfaces 14, 14' as shown in FIG. 2. As also shown in FIG. 2, the side edges 5, 7 extend substantially normally of the internal surfaces 14, 14' and 12, 12'. The terminal has a wire-receiving and wire contacting section 16 which extends from an intermediate location 18 to the upper or free end 6 of the terminal, the intermediate location 18 being between the free end 6 and the inner end 8. The opposed internal surfaces are recessed as shown in FIG. 2 at 20, 22, 20', 22' in the wire-receiving and contacting section and the space between the opposed surfaces in this section of the terminal therefore constitutes the wire-receiving slot of the terminal. It will be noted in FIG. 2 that the surfaces 20, 20' are spaced apart by a distance which is greater than the distance between the surfaces 22, 22'. The surfaces 22, 22' are, in effect the tops of ridges on the surfaces 20, 20'. The surfaces 22, 22' are the actual wire contacting surfaces and if desired, these surfaces can be roughened as by serrations so that improved contact with the wire will be obtained. Additionally, the upper ends 23 of these surfaces can be beveled or otherwise formed to cut through varnish type insulation on the wire or any oxide coating which might be on the wire.

A wire 24 can therefore be connected to the terminal by positioning the wire with its axis extending parallel to the plate-like members and in alignment with the wire-receiving slot 17. The wire is then moved downwardly until it moves past the upper ends 23 of the portions 22 of the surfaces. The wire will then be pinched between these surfaces and contact will be established.

The two plate-like members 10, 10' are connected to each other in a connecting zone 26 which is between the intermediate location 18 and the inner end 8 of the shank portion 4. The two plate members are preferably joined to each other by a welding process such as spot welding, pressure welding, or ultrasonic bonding, as indicated at 29 in FIG. 3, although other joining methods might be used. Welding is, however, the preferred method of joining the two parts to each other and this procedure for joining the parts can be used in a method of producing the terminals in strip form as will be described below.

Terminals in accordance with the invention can be produced from any desirable conductive metal having sufficient strength to satisfy the requirements of the intended use of the terminal. Phosphor bronze is a preferred material although terminals might be produced from beryllium copper alloys or ordinary brasses. The blanks for producing the plate-like members 10, 10' are stamped from sheet metal stock having a thickness equal to the thickness of either of the members 10, 10'. The surfaces 26, 26' and the external surfaces 12, 12' would be the rolled surfaces of the sheet metal stock. The side or edge surfaces would, of course, be sheared surfaces.

The reduced thickness of the wire-receiving and contact portions of the plate members 10, 10' is preferably produced by a coining operation, that is a forming operation in which the blank is confined under very high pressure in coining dies which cause the metal to flow to the precise shape shown in FIG. 2. This is a preferred forming method for the terminal for the reason that the coining operation causes severe cold working of the metal and as a result, the contact portions or sections 16 and contacts 28, 28' are hardened and strengthened. Additionally, coining is a very precise metal working operation and the width of the gap or slot between the surfaces 22, 22' can be precisely controlled.

Terminals in accordance with the present invention can be used in multicontact electrical connectors as described in the above-identified U.S. patent application Ser. No. 704,458 or the principles of the invention can be used wherever wire-in-slot terminals are required.

Figure 5:
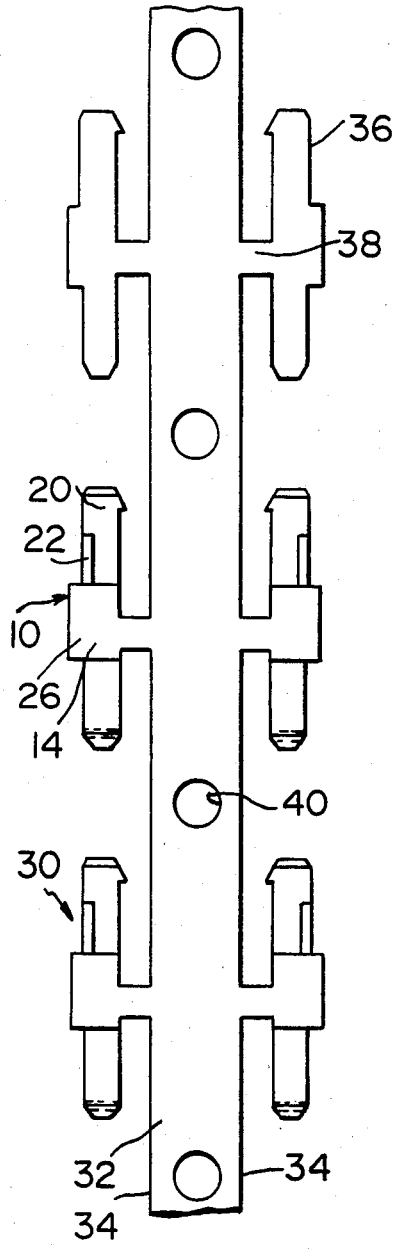
FIG. 5 is a plan view of a section of strip illustrating the manner in which the blanks for the parts of the terminal may be stamped from the strip and subsequently coined and formed.
Figure 6:
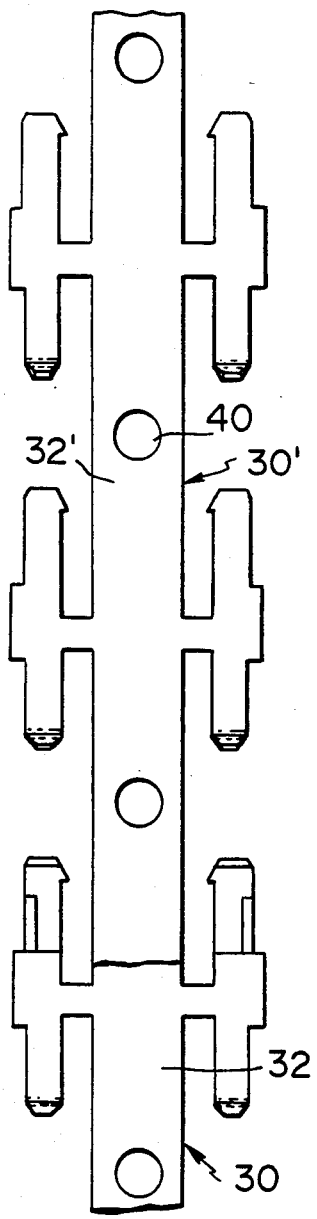
FIG. 6 is a view similar to FIG. 5 illustrating the manner in which two strips as shown in FIG. 5 are positioned against each other to produce the finished terminals.

FIGS. 5 and 6 illustrate the manner in which terminals in accordance with the invention can be produced in strip form. As shown in FIG. 5, a continuous strip 30 of the parts 10 or 10', FIG. 2, can be produced by first forming the flat blanks 36 on each side of a central carrier strip 32 with the individual blanks connected to the carrier strip by connecting sections 38. After the blanks are stamped from the metal strip, the coining and trimming operations are carried out and the contact arms are formed or bent as also shown in FIG. 5. Thereafter, the contact areas may be plated if desired.

In the manufacture of the terminals then, two strips which are identical to each other are positioned against each other as shown by the strip 30 and the strip 30' in FIG. 6 with the sides edges 34 of the strips in alignment and with the pilot holes 40 in registry. When the strips are positioned against each other in this manner, a bipartite terminal is produced at the site of each of the plate members of each strip. The bipartite strip of FIG. 6 can then be fed through a welding machine or the like and the two plate-like members 10, 10' can be welded to each other as the strip passes the welding station. Under many circumstances, it may be desirable to maintain the terminals as part of the continuous strip of FIG. 6 so that when the terminals are inserted into a connector housing or otherwise placed in a housing, they can be removed from the strip by suitable shearing and insertion machines and inserted automatically into the housing.

Figure 3:
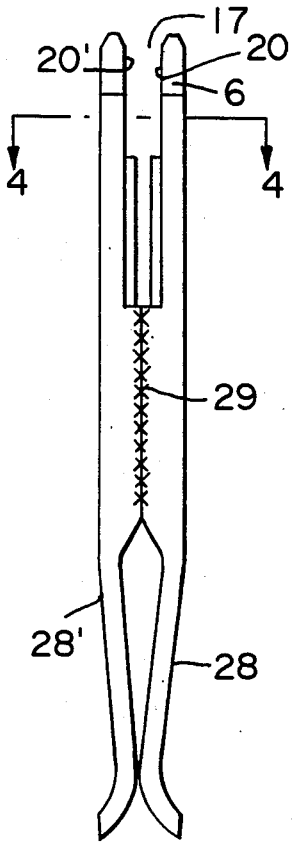
FIG. 3 is a view looking in the direction of the arrows 3—3 of FIG. 1.
Figure 4:
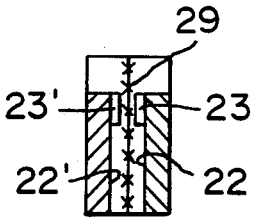
FIG. 4 is a view looking in the direction of the arrows 4—4 of FIG. 3.

Terminals in accordance with the present invention have certain advantages for particular circumstances and may be preferable to the types of terminals shown in Application Ser. No. 704,458 under some circumstances. The manufacture of terminals in accordance with the invention does not require the folding step of the terminals in Application Ser. No. 704,458, and the avoidance of this folding step may be advantageous where the material or stock metal from which the terminal is produced cannot be readily folded. A further advantage of the present invention is that excellent control is maintained over the width of the wire-receiving slot of the terminal, that is over the distance separating the surfaces 22, 22' in the finished terminal as shown in FIG. 3. As noted above, the coining operation is an extremely precise operation and the surfaces 26, 26' are flush against each other in the finished terminal. It follows, that excellent manufacturing control can be maintained over the spacing between the surfaces 22, 22'.

It will be understood that terminals in accordance with the invention, when used in connectors as described in Application Ser. No. 704,458, can be connected to the conductors in multiconductor cables as explained in that application.

I claim:

1. A sheet metal electrical terminal of the type comprising a shank portion having first and second plate-like members in side-by-side aligned relationship, the plate-like members having opposed first and second major internal surfaces, the shank portion having a free end, an inner end, and first and second side edges extending from the free end to the inner end, the shank portion having a wire-receiving and contacting section which extends from the free end to an intermediate location which is between the free end and the inner end, the opposed first and second internal surfaces being spaced apart in the wire-receiving and contacting section whereby a wire-receiving slot is provided between the first and second opposed internal surface, the slot extending from the free end towards the intermediate location, the terminal being characterized in that:

the terminal comprises first and second substantially similar flat sheet metal parts, the first and second sheet metal parts being the first and second plate-like members respectively, the opposed first and second major internal surfaces being substantially against each other in a connecting zone, the connecting zone being between the intermediate location and the inner end of the shank portion, and the first and second sheet metal parts are secured to each other in the connecting zone.

2. A sheet metal electrical terminal as set forth in claim 1 characterized in that the first and second sheet metal parts are secured to each other in the connecting zone by welding.

3. A sheet metal electrical terminal as set forth in either of claims 1 or 2 characterized in that the plate-like members are coined to reduced thicknesses in the wire-receiving and contacting sections.

4. A sheet metal electrical terminal as set forth in either of claims 1 or 2 characterized in that at least one contact terminal arm extends from the inner end of the shank portion.

5. A sheet metal electrical terminal as set forth in either of claims 1 or 2 characterized in that the first and second plate-like members have first and second contact terminal arms extending therefrom at the inner end of the shank portion.

6. A sheet metal electrical connecting device having contacting means for making contact with a wire, the device being of the type having a free end and an inner end portion which is spaced from the free end, a wire receiving slot extending inwardly from the free end towards the inner end portion, the slot having an entrance portion which has a width which is greater than the wire and a contact portion which has a width which is less than the thickness of the wire, the entrance portion extending from the free end to an intermediate location which is between the free end and the inner end portion, the contact portion extending from the intermediate location towards the inner end portion whereby upon movement of the wire laterally of its axis and into the slot, electrical contact will be established in the contact portion, the connecting device being characterized in that:

the connecting device comprises a pair of plate members which are in side by side parallel aligned relationship, the plate members having oppositely facing external major surfaces and opposed parallel internal major surfaces, each of the plate members having side edges extending from the free end to the inner end portion, the side edges extending substantially normally of the opposed parallel internal surfaces, the plate members being spaced apart in the zone which extends from the free end to the inner end portion and being secured to each other at the inner end portion, the wire-receiving slot being the space between the opposed parallel internal surfaces, at least one of the internal surfaces having thereon a ridge which projects towards the other internal surface and which extends from the intermediate location towards the inner end portion, the ridge defining the contact portion of the slot.

7. A sheet metal connecting device as set forth in claim 6, characterized in that each of the opposed parallel internal surfaces has a ridge thereon, the ridges being in mutually opposed aligned relationship.

8. A sheet metal connecting device as set forth in claim 7 characterized in that the opposed parallel internal surfaces are coined surfaces, the ridges having been produced by coining operations.

9. A sheet metal connecting device as set forth in claim 8 characterized in that the plate members are secured to each other by welding.

* * * * *